US005942008A

United States Patent [19]

Curto

[11] Patent Number: 5,942,008

[45] Date of Patent: Aug. 24, 1999

[54] METHOD OF DYEING WOOD VENEER AT ELEVATED TEMPERATURES AND PRESSURES

[76] Inventor: Calogero Curto, 148 Kaiser Drive, Woodbridge, Ontario, Canada, L4L 3V4

[21] Appl. No.: 08/873,157

[22] Filed: Jun. 11, 1997

[51] Int. Cl.[6] ..... D06P 3/60

[52] U.S. Cl. ..... 8/402; 8/505; 8/611; 8/934

[58] Field of Search ..... 8/402, 505, 611, 8/646, 934; 427/440, 441

[56] References Cited

U.S. PATENT DOCUMENTS

| | | | |
|---|---|---|---|
| 2,052,172 | 8/1936 | Frolich | 8/402 |
| 3,900,615 | 8/1975 | Dunn, Jr. | 8/402 |
| 3,959,529 | 5/1976 | Winn et al. | 8/402 |
| 3,968,276 | 7/1976 | Allen | 427/440 |
| 5,171,328 | 12/1992 | Trauth et al. | 8/402 |
| 5,480,680 | 1/1996 | Vieyra | 427/388.4 |

FOREIGN PATENT DOCUMENTS

| | | |
|---|---|---|
| 208816 | 4/1984 | Germany . |
| 4316234 | 11/1994 | Germany . |
| 54-126703 | 10/1979 | Japan . |
| 54-126704 | 10/1979 | Japan . |

OTHER PUBLICATIONS

English language translation of DE 4,316,234, Schweiger, pp. 1–7. Nov. 1994.

Grant & Hackh's Chemical Dictionary, Fifth Edition, McGraw Hill Book Company, p. 632. 1987.

*Primary Examiner*—Caroline D. Liott

[57] ABSTRACT

The present invention relates to a method for dyeing wood veneer. The veneer is immersed in a dye bath. The dye is preferably heated to speed up penetration times. The dye bath containing the veneer is then put into pressurized chamber and pressurized to 50–500 psi. The chamber is pressurized until the wood absorbs the amount of color that is desired. When the color is absorbed the pressure is released and the veneer is removed. The veneer is then washed with water until there is no bleeding and then air dried.

6 Claims, 1 Drawing Sheet

METHOD OF DYEING WOOD VENEER AT ELEVATED TEMPERATURES AND PRESSURES

BACKGROUND OF THE INVENTION

1. Field of the Invention

This invention relates to dyeing wood veneer. In particular the present invention provides an apparatus and method of dyeing the veneer so that the colour is ingrained into the veneer.

2. Description of the Prior Art

The increase in demand for all wood products has created increasing scarcities and high prices for high quality wood particularly hardwood. Wood veneers are becoming more and more common particularly in the manufacture of wooden furniture. The veneer can be finished in a number of conventional methods such as painting, staining or spraying. Alternatively the veneer can be prefinished with clear lacquers, oils, stains, toners or wash coats. All of these methods are surface treatments and where a colour is desired: (1) the colour does not penetrate into the veneer, (2) potentially environmentally harmful chemicals are needed (3) if the stain or other material being applied to provide colour is not transparent the wood grain cannot be seen and (4) the process used to apply the colour (screening, spraying, roller application, brushing or paint jet) is time consuming & aggravating due to the use of the chemicals needed.

Various methods have been previously developed to overcome some of these problems. U.S. Pat. No. 5,338,570 describes a method of finishing an article of wooden furniture comprising the steps of dipping the article into a coating material for at least 10 seconds, removing the article and draining it for about 20 seconds then spinning the dipped and drained article at a rate of 80 RPM's for evenly distributing the coating.

U.S. Pat. No. 4,657,789 describes a method for the production of veneer resistant to micro-organisms comprising applying a concentrated solution of impregnation salt to the surface of the veneer while the veneer is still moist after being cut or sliced from a piece of timber, under no mechanical pressure and before the ring pores are sealed, so that the impregnation salt is evenly distributed in the veneer by chemical osmotic diffusion through the cell walls and then heating the veneer to dry it and seal the ring pores.

U.S. Pat. No. 4,376,141 describes a process for coloring maple wood or maple veneer. The process involves coating the surface of the wood or veneer with a sugar water composition and then subjecting the coated wood to simultaneous application of heat (100° F. to 900° F.) and pressure (5 psi to 2000 psi). The degree of colour is varied by adjusting the temperature or amount of shading agent such as strontium nitrate (approximately 0.4%).

U.S. Pat. No. 3,622,380 describes a method of coloring wood involving contacting the wood with an aqueous solution of furfuryl alcohol, a catalyst selected from the group consisting of iron, nickel, cobalt, copper, zinc and cadmium and a complexing agent then heating.

The present invention solves a number of problems associated with the prior art namely: it does not use environmentally harmful substances like the chemicals used today for staining wood such as solvents and spirits; the consistency of the colour can be maintained at all times; colored wood can be purchased without the concern of having minor damages, such as scratches, that may result during the production of furniture and or paneling, requiring repair. The invention is a simplified finishing process of the wood used for furniture whereby the veneer is provided in a variation of colours that is penetrated into the wood.

SUMMARY OF THE INVENTION

It is an object of the invention to provide a method of dyeing wood veneers.

It is a further object of the invention to provide a method of dyeing wood veneers so that the dye penetrates through the veneer resulting in a consistent colour.

It is a further object of the invention to provide a method that uses environmentally friendly substances for dyeing veneer.

Thus in accordance with the present invention there is provided a method and apparatus for dyeing wood veneer. The veneer is immersed in a dye bath The dye is preferably heated to about 70° to 90° C. to speed up penetration times. The dye bath containing the veneer is then put into pressurized chamber and pressurized to 50 to 500 psi preferably 100–200 psi. The chamber is pressurized until the wood absorbs the amount of colour that is desired. When the colour is absorbed the pressure is released and the veneer is removed. The veneer is then washed with water until there is no bleeding and then air dried.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
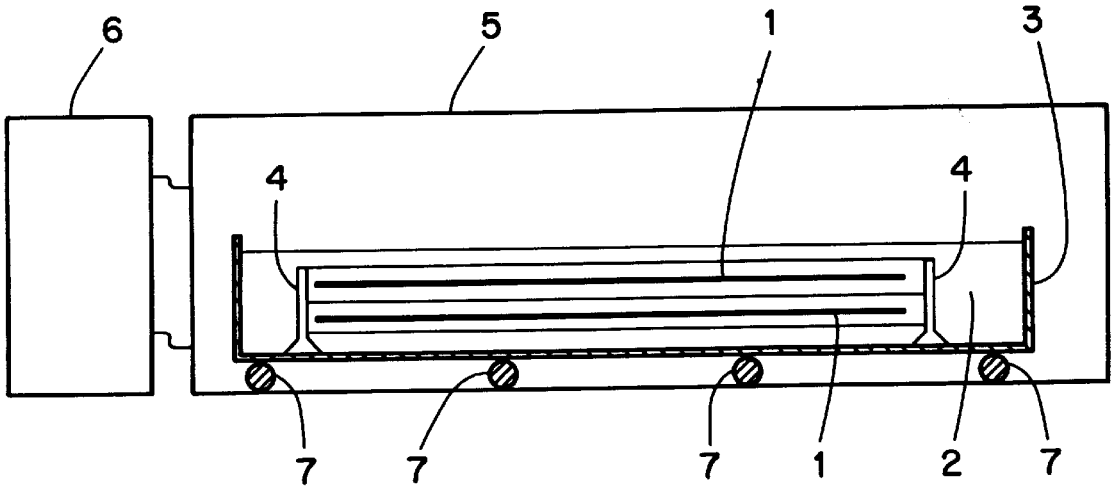
FIG. 1 is a schematic representation of the apparatus of dyeing wood veneer according to the present invention.
Figure 2:
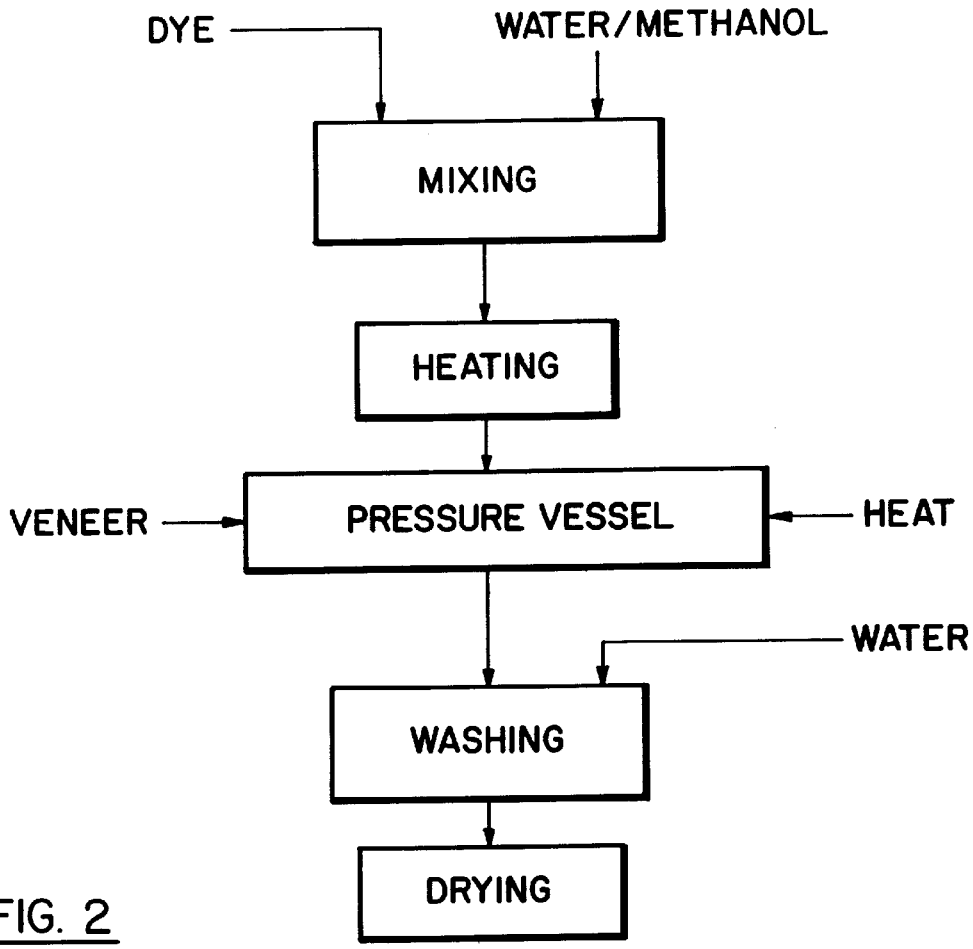
FIG. 2 is a schematic representation of the method of dyeing wood veneer according to the present invention.

Referring to FIG. 1 and 2, a method and apparatus for dyeing wood veneer according to the present invention is schematically illustrated. The veneer 1 to be colored is immersed in a dye bath 2 in a container 3. Dyes can be natural or synthesized from benzenoid hydrocarbons obtained from coal tar or petroleum. There are over 7000 different synthetic dyes currently in use in the textile, leather, paper food and cosmetics industries. Dyes are distinguished from pigments in that they are soluble in the application medium, usually water whereas pigments are insoluble. In the present invention a water/alcohol solution has been found preferably as a solvent over water. Other solvents that are finding acceptance in the dyeing industry may also be utilized. Pigments are used in manufacturing printing inks, paints, automobile finishes and incorporated into plastics and rubbers. The present invention utilizes dyes which have a molecule size that can be absorbed into the wood. Hardwoods have pores which vary in size from about 50 to 300 micrometers and the dye selected should, when dyeing hardwoods according to the present invention, have a molecule size less than the pore size top permit penetration into the wood. Otherwise the dye will remain only on the surface of the veneer. The inventor has found that Trichromatic dyes manufactured by Techno Chem in Montreal, Canada had the best performance of the various dyes tested.

In the preferred embodiment where it is desirable to dye several strips of veneer at the same time, a rack 4 can be provided onto which the veneer strips can be placed. The rack 4 must be adapted so that the dye can be absorbed on the whole surface of the veneer to avoid lines of uneven colour. The dye 2 is preferably heated to about 70° to 90° C. to speed up penetration times. It is desirable to maintain the temperature of the dye at these temperatures for the length of time it takes to complete the process. Accordingly heating means may be provided in container 3 or the pressure chamber 5. The container 3 containing the veneer and dye is then put into pressurized chamber 5. The chamber can be any configuration but for dyeing long strips of veneer a cylindrical or rectangular shape is most practical. is pressurized to 100–200 psi. In the preferred embodiment the pressure chamber 4 is a cylindrical shape with access through end door 6. Rollers 7 permit container 3 to be easily inserted and removed from the pressure chamber 5. Use of the separate container 3 rather than filling the pressure chamber 5 with the dye directly simplifies the cleaning of the containers after one colour and before repeating the process with another colour dye. After the veneer is dyed, the solution containing the dye can be reused with additional solvent added three or four times without affecting the final hue obtained.

Softwood veneers such as fir, cedar, larch, spruce, pine, redwood, yew and hemlock require less pressure for the dye to penetrate into the veneer. Hardwood veneers such as maple, chestnut, alder, birch, hickory, beech, ash, walnut, poplar, cherry, oak and elm, require a higher pressure to obtain effective penetration of the dye through the veneer. Pressures of 50 to 500 psi will result in penetration and in the preferred embodiment to obtain penetration in a reasonable period of time pressures of 100 to 200 psi have proven acceptable. Care should be exercised at pressures in excess of 175 psi to avoid the integrity of the wood being negatively compromised. The chamber is pressurized until the wood absorbs the amount of colour that is desired. At pressures of 100 to 200 psi the time required for penetration is about 4 to 6 hours. Lower pressures will result in slower penetration times. When the colour is absorbed the pressure is released and the veneer is removed. The veneer is then washed with warm water until there is no bleeding and then air dried.

The resulting veneer is a consistent colour such as yellow, green, blue, red and the dye has penetrated completely through the veneer. The veneer can be sanded, cut etc without damaging or changing the colour avoiding the need to touch up these areas as in conventional methods which are difficult to get colour matches. The dye because it penetrates into the wood enables a wide variety of colours to be obtained without masking the grain of the wood. A lacquer or other finish can be applied over the veneer to further protect the finished object.

EXAMPLES

Example 1

A Trichromatic red dye is dissolved in two parts by volume of water and one part by volume methanol. The solution is heated to 80° C. A strip of pine veneer (softwood) is placed into the dye bath. The dye bath is then placed in a pressurized vessel at 130 psi for four hours. The veneer is then removed from the pressure vessel and washed under warm water until there is no bleeding of the dye from the veneer. The veneer is then air dried. Inspection reveals that veneer is a consistent colour and the dye has penetrated completely through the veneer. The veneer can be sanded, cut etc without damaging or changing the colour.

Example 2

A Trichromatic light blue dye is dissolved in two parts by volume of water and one part by volume methanol. The solution is heated to 90° C. A strip of walnut veneer (semi-hard wood) is placed into the dye bath. The dye bath is then placed in a pressurized vessel at 150 psi for five hours. The veneer is then removed from the pressure vessel and washed under warm water until there is no bleeding of the dye from the veneer. The veneer is then air dried. Inspection reveals that veneer is a consistent colour and the dye has penetrated completely through the veneer. The veneer can be sanded, cut etc without damaging or changing the colour.

Example 3

A Trichromatic dye being a combination of red and light blue is dissolved in two parts by volume of water and one part by volume methanol. The solution is heated to 95° C. A strip of oak veneer (hardwood) is placed into the dye bath. The dye bath is then placed in a pressurized vessel at 250 psi for six hours. The veneer is then removed from the pressure vessel and washed under warm water until there is no bleeding of the dye from the veneer. The veneer is then air dried. Inspection reveals that veneer is a consistent colour and the dye has penetrated completely through the veneer. The veneer can be sanded, cut etc without damaging or changing the colour.

Having illustrated and described a preferred embodiment of the invention and certain possible modifications thereto, it should be apparent to those of ordinary skill in the art that the invention permits of further modification in arrangement and detail without departing from scope of invention. All such modifications are covered by the scope of the invention.

The embodiments of the invention in which an exclusive property or privilege is claimed are defined as follows:

1. A method of coloring wood veneer comprising the steps of:

(a) heating to about 70° to 90° C. an aqueous/alcohol solution of two parts by volume water and one part by volume methanol and containing a dye synthesized from benzenoid hydrocarbons obtained from coal tar or petroleum;

(b) placing a strip or strips of veneer in the heated solution of dye;

(c) placing the veneer and solution of dye in a pressure vessel at from 50 to 500 psi until the dye penetrates through said veneer;

(d) removing the colored veneer from the pressure vessel and washing to remove any excess dye solution, and (e) drying the veneer.

2. A method according to claim 1 wherein the dye has a molecule size less than the pore size of the wood veneer to be coloured.

3. A method according to claim 2 wherein the wood veneer is a hardwood selected from the group consisting of maple, chestnut, alder, birch, hickory, beech, ash, walnut, polar, cherry, oak and elm.

4. A method according to claim 1 wherein the wood veneer is a softwood selected from the group consisting of fir, cedar. larch, spruce, pine, redwood, yew and hemlock.

5. A method according to claim 1 wherein the pressure vessel is operated at 100 to 200 psi.

6. A method according to claim 1 wherein the veneer is washed in warm water in step (d).

* * * * *